United States Patent [19]

Boyd

[11] Patent Number: 4,658,453

[45] Date of Patent: Apr. 21, 1987

[54] WAVE-RETARDING WATERBED MATTRESS

[76] Inventor: Dennis Boyd, 14457 Rogue River, Chesterfield, Mo. 63017

[21] Appl. No.: 851,106

[22] Filed: Apr. 14, 1986

[51] Int. Cl.[4] ..... A47C 27/08

[52] U.S. Cl. ..... 5/450; 5/451

[58] Field of Search ..... 5/451, 452, 449, 450, 5/457, 458

[56] References Cited

U.S. PATENT DOCUMENTS

| | | | |
|---|---|---|---|
| 4,332,043 | 6/1982 | Larson | 5/451 |
| 4,467,485 | 8/1984 | Hall | 5/451 |
| 4,517,691 | 5/1985 | Phillips | 5/451 |

FOREIGN PATENT DOCUMENTS

| | | | |
|---|---|---|---|
| 48209 | 9/1982 | European Pat. Off. | 5/451 |

*Primary Examiner*—Alexander Grosz

*Attorney, Agent, or Firm*—Coburn, Croft & Putzell

[57] ABSTRACT

A wave-retarding waterbed mattress comprising an envelope of supple sheet material for containing a liquid hterein and a free floating wave motion retarding baffle within the hollow interior of the envelope. The baffle comprises a plurality of bouyant sheets and a generally horizontally extending layer of material. The layer is positioned on the bouyant sheets with portions of the layer downwardly depending between the buoyant sheets when the mattress is filled with liquid.

5 Claims, 3 Drawing Figures

WAVE-RETARDING WATERBED MATTRESS

BACKGROUND OF THE INVENTION

This invention relates to a waterbed mattress, and more particularly to a waterbed mattress having means for retarding wavelike motion of the water within the mattress.

Waterbeds have become increasingly popular with the general public; however, many people are bothered by the wavelike motion of the water in such beds, and this has caused waterbeds to be excluded from consideration by many consumers. There have been numerous attempts to eliminate the wavelike motion in waterbed mattresses and reference may be made to U.S. Pat. Nos. 4,241,465, 4,292,702, 4,399,575, 4,462,128, 4,467,485 and 4,475,257.

SUMMARY OF THE INVENTION

Among the several objects of the invention may be noted the provision of an improved waterbed mattress which substantially reduces and virtually eliminates the direct as well as reflective wave motion in liquid filled mattresses; the provision of such a waterbed mattress which maintains its structure after prolonged use; and the provision of a waterbed mattress which is of simple and economical construction and is convenient and inexpensive to package for shipping.

In general, the wave-retarding mattress of this invention comprises an envelope of supple sheet material for containing a liquid therein and a free floating wave motion retarding baffle within the hollow interior of the envelope. The baffle comprises a plurality of bouyant sheets and a generally horizontally extended layer of material. The layer of material is positioned on the bouyant sheets with portions of the layer downwardly depending between the bouyant sheets when the mattress is filled with liquid.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
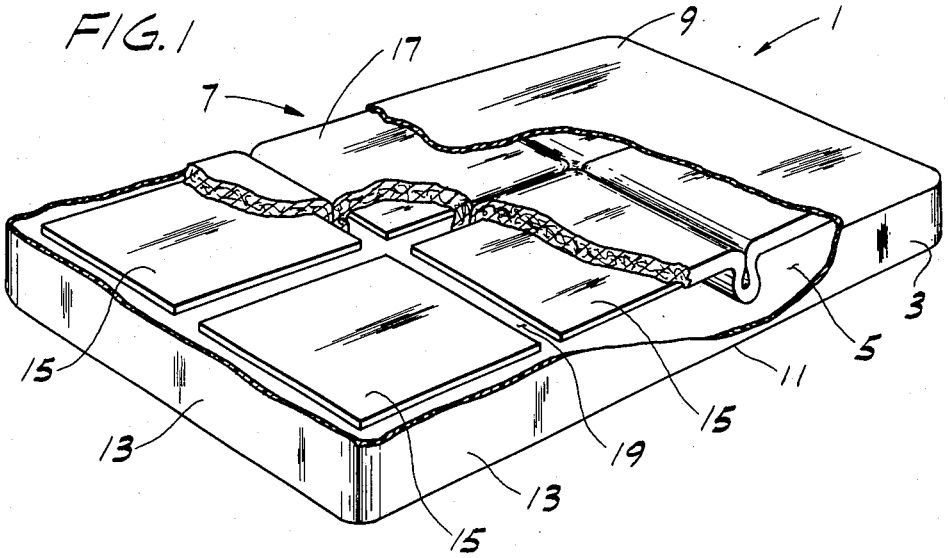
FIG. 1 is a perspective view, partly broken away, of a waterbed mattress according to the present invention.

Referring to FIG. 1 of the drawings, there is indicated generally at 1 a waterbed mattress of this invention comprising an envelope or bladder of supple sheet material 3 for containing a liquid 5, such as water, therein and a free floating wave motion retarding baffle 7 within the hollow interior of the envelope. More particularly, the mattress 1 is generally rectangular in shape having top 9, bottom 11 and side 13 surfaces. The mattress can be of any sealable and water-tight material. It is preferred that the material be relatively thin, e.g., 22 mil thick, and made of flexible material, preferably vinyl. Although not shown in the drawings, it will be understood that the bottom surface 11 of the liquid-filled mattress rests primarily on the top surface of a flat rigid, preferably rectangular, platform or the base of a rigid frame structure. The elongated side panels or riser boards of the rigid frame structure support the sides 11 or peripheral portion of the liquid-filled mattress. In addition, a waterheater and thermostat are usually located in the platform or base of the support structure for warming the mattress to the desired comfort level, as will be understood by those familiar in the art.

The baffle 7 of this invention creates a resistance to the flow of liquid around it for the purpose of restricting wave motion within the liquid-filled mattress. As best shown in FIG. 1, the baffle comprises a plurality of bouyant sheets 15 and a generally horizontally extending layer of material 17.

Figure 2:
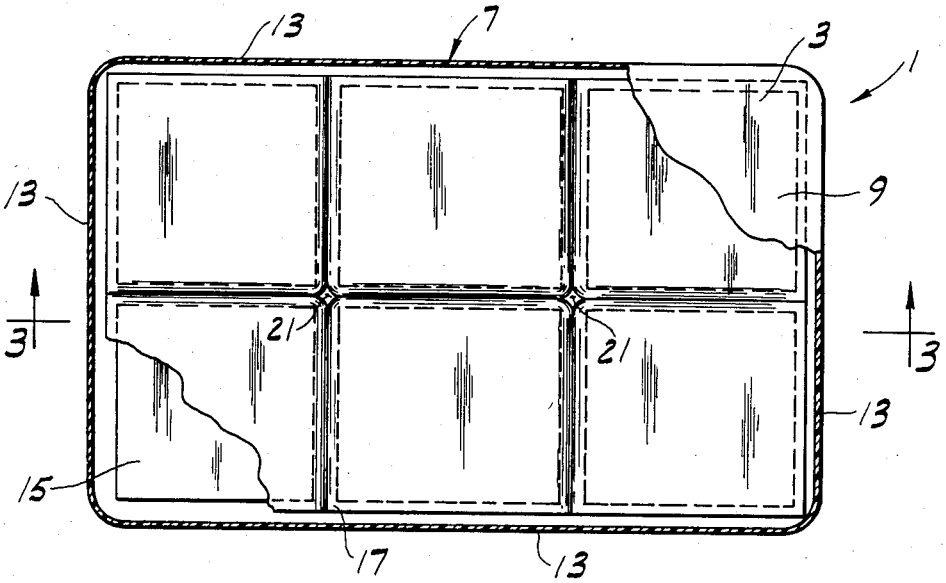
FIG. 2 is a top plan of the waterbed mattress with parts partially broken away to illustrate details.

As particularly shown in FIG. 2, this embodiment uses six bouyant sheets 15; however, it will be understood that any number of sheets may be used. The sheets are fabricated from material which has a low density for substantial bouyancy and is of considerable structural integrity. Moreover, each sheet should be pliable and adapted to be bent out of its normal plane disposition. The preferred material is known in the industry as EVA and has all the desired characteristics and maintains its structure after prolonged use. Furthermore, it is desirable that the edges of each sheet be soft, depressible and therefore conducive to conforming to the body contours of a person reclining on the mattress and will not be deformed when bent. The use of such a material reduces the possibility of damage to the envelope by puncturing. As seen in the drawings, the sheets are spaced from each other so as to cause gaps 19 therebetween, the purpose of which will be obvious later.

Figure 3:
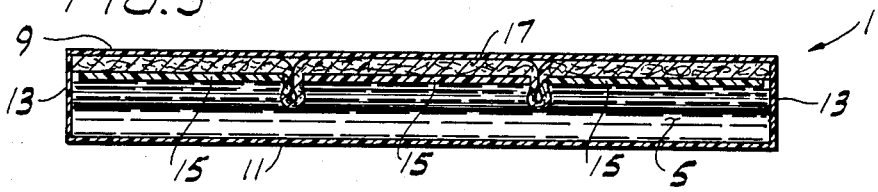
FIG. 3 is a vertical section taken on line 3—3 of FIG. 2.

The layer of material 17 is positioned on the bouyant sheets 15 with portions of the layer downwardly depending between the bouyant sheets and through gaps 19 when the mattress is filled with liquid. Preferably the layer is formed of fibrous material which is a porous, foldable and compressible mass of bound together fibers. The fiber has a resin coating which serves to bond the fiber to deter the disjointing or separation of the fiber layer. Moreover, a porous fiber has been found to be extremely effective in dampening water wave action. As seen in FIGS. 2 and 3, the layer of fiber material 17 is positioned on the layer of sheets thereby resulting in it being generally sandwiched between the sheets 15 and top surface 9 of the mattress. Portions of the fiber layer downwardly depend between the bouyant sheets when the mattress is filled with liquid. The fiber layer 17 has small cut-outs 21 at the intersection of the sheets in order to facilitate this draping effect. The draping of the fibrous material between each sheet results in a loop 23 of fibrous material and causes the damping of the wave motion to be localized beneath each individual sheet, thereby diminishing the time for eliminating the wave motion and restraining the wave motion from affecting the other areas of the mattress. Such an arrangement virtually eliminates the direct as well as the reflective wave motion in the mattress. Although not shown in the drawings, it will be understood that the 6 loops 23 may be tied-off with nylon thread or the like just below the sheets 15. This will assist in keeping the fiber loops 23 from shifting up onto the sheets. It will also be apparent that the loops may be riveted with a stainless steel rivet or suitably attached to the sheets in order to prevent the loops from shifting up onto the sheets.

It will be understood that the layer of fibrous material 17 and the layer of sheets 15 can be joined by riveting, sewing or the like thereby preventing the fiber sheets from shifting and sinking after prolonged use. Moreover, the rigidity of each sheet 15 also prevents the layer of fiber from turning under the sheets when the mattress is filled with liquid. All of this keeps the fiber off the bottom of the mattress and prevents "hot spots" from occurring which oftentimes leads to the burning out of the heater or possibly the burning of the mattress. In addition, it allows for the even dissipation of the heat from the heating element.

It will be further understood from the above description that the use of independent bouyant sheets and fibrous material which drapes downward reduces the amount of fibrous material which otherwise would be necessary to achieve the same results thereby reducing the cost of internal materials and making the mattress easier to store and ship. Moreover, the use of multiple bouyant sheets and fiber allows the mattress to be folded on the fold areas due to the gap between float sheets which also aids in shipping and helps preserve the life of the baffles.

In view of the above, it will be seen that the several objects of the invention are achieved and other advantageous results attained.

As various changes should be made in the above constructions without departing from the scope of the invention, it is intended that all matter contained in the above description or shown in the accompanying drawings shall be interpreted as illustrative and not in a limiting sense.

What is claimed is:

1. A wave-retarding waterbed mattress comprising an envelope of supple sheet material for containing a liquid therein, and a free-floating wave motion retarding baffle within the hollow interior of the envelope, said baffle comprising at least four buoyant, substantially rectangular sheets, on the top of which is joined a unitary layer that forms at least two downwardly depending loops that are substantially perpendicular to each other, said loops depending downwardly in gaps formed between adjacent sides of said sheets, the baffle having a horizontal surface that substantially corresponds to the horizontal surface of the mattress.

2. A wave-retarding waterbed mattress as set forth in claim 1 wherein said bouyant sheets are horizontally disposed and comprised of flexible material.

3. A wave-retarding waterbed mattress as set forth in claim 1 wherein said horizontal layer is a layer of fibrous material.

4. A wave-retarding waterbed mattress as set forth in claim 1 wherein said liquid is water.

5. A wave-retarding waterbed mattress as set forth in claim 1 wherein said unitary layer and sheets are fastened together by rivetting, sewing or the like.

* * * * *